United States Patent [19]

Lissner

[11] Patent Number: 4,747,011

[45] **Date of Patent: * May 24, 1988**

[54] ANTI-STATIC CHAIR

[76] Inventor: David Lissner, 5250 Briggs Ave., La Crescenta, Calif. 91214

[ * ] Notice: The portion of the term of this patent subsequent to Nov. 25, 2003 has been disclaimed.

[21] Appl. No.: 928,531

[22] Filed: Nov. 7, 1986

Related U.S. Application Data

[63] Continuation-in-part of Ser. No. 704,162, Feb. 22, 1985, Pat. No. 4,625,257, which is a continuation of Ser. No. 672,617, Nov. 19, 1984, abandoned.

[51] Int. Cl.[4] ..... H05F 3/02

[52] U.S. Cl. ..... 361/212; 361/220; 297/217

[58] Field of Search ..... 297/217; 361/212, 216, 361/219, 220, 223

[56] References Cited

U.S. PATENT DOCUMENTS

| | | | |
|---|---|---|---|
| 2,858,482 | 10/1958 | Nutter | 361/216 |
| 4,208,696 | 6/1980 | Lindsay et al. | 361/212 |
| 4,307,144 | 12/1981 | Sanders et al. | 428/240 |
| 4,513,347 | 4/1985 | Wilcox et al. | 361/220 |
| 4,625,257 | 11/1986 | Lissner | 361/212 |

OTHER PUBLICATIONS

"Condulon Low & High Density Conductive Foams" brochure, Bemis Company, Minneapolis, Minn., 5--1-82.

Anti-Static and Conductive Foam brochure, Controlled Static, Santa Fe Springs, Calif.

*Primary Examiner*—L. T. Hix
*Assistant Examiner*—David M. Gray
*Attorney, Agent, or Firm*—Sheldon & Mak

[57] ABSTRACT

A chair for discharging static electricity carried by an occupant has a seat covering and an electrode under the covering for permitting the occupant to safely touch a source of current having a moderate voltage of less than about 200 volts, without being shocked thereby. When the charge exceeds a predetermined level, current flows through the covering between the occupant and the conductor, discharging the occupant. The electrode can be a flexible wire or a resilient foam member. A current limiting resistor protects the occupant from high discharge currents. In a preferred version, there are two of the resistors connected in parallel for fall-safe operation. The chair can have a wheeled base of electrically conductive construction for grounding the chair. The chair can incorporate a hydraulic cylinder for permitting height adjustments and swivelling of the seat, it being preferred that the two current limiting resistors be incorporated in the cylinder for including structure under the seat in the protection from high discharge currents, and for ease of manufacture. In one version of the chair, a discrete breakdown device prevents discharge from moderate voltages and the covering can be made conductive.

17 Claims, 3 Drawing Sheets

26
24
28
30
13
10
12
82
80
14
86
84
30
16
30
20
86
22
32
35
34
37
36
63
64
60
62
66
70
15
68
38
44
40
40
42
11
72
42
63
64
32
60
62
60
66
66
70
68

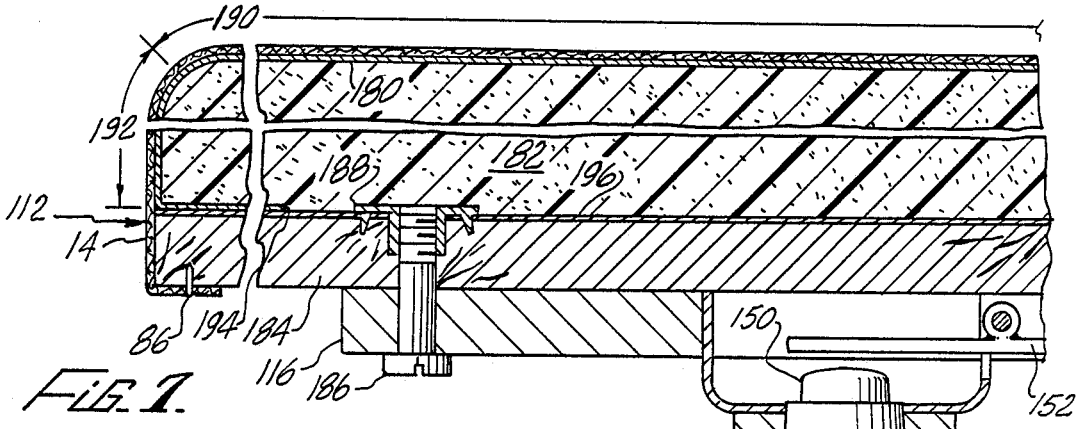
FIG. 7.
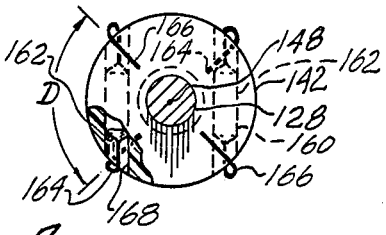
FIG. 8.
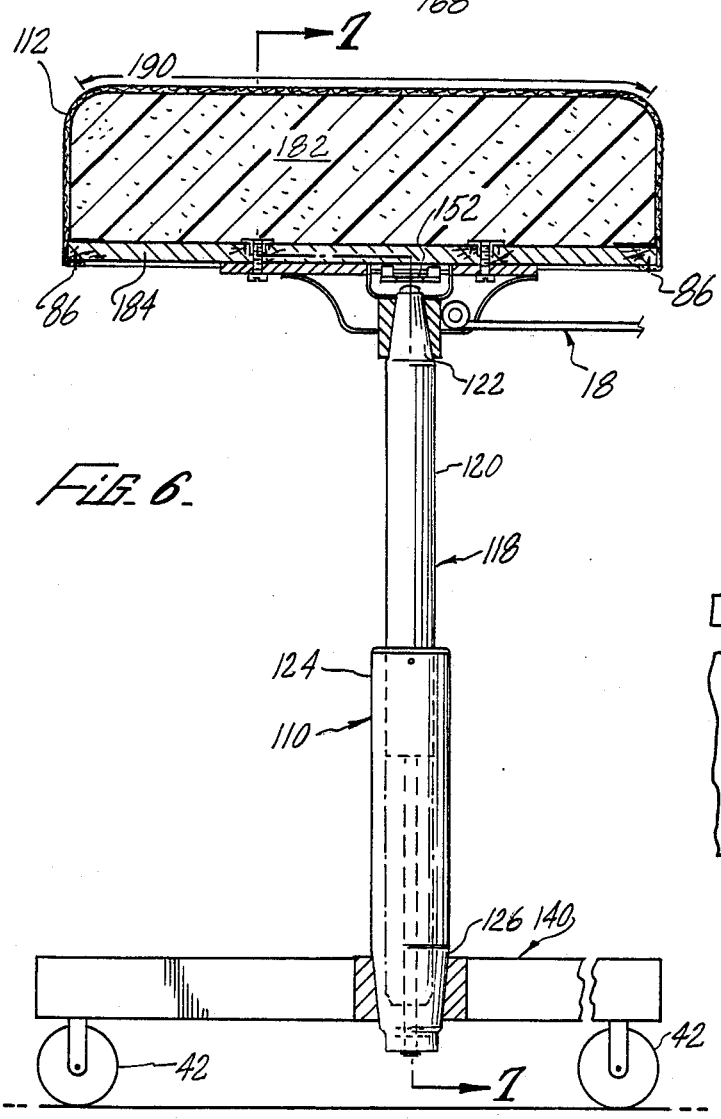
FIG. 6.
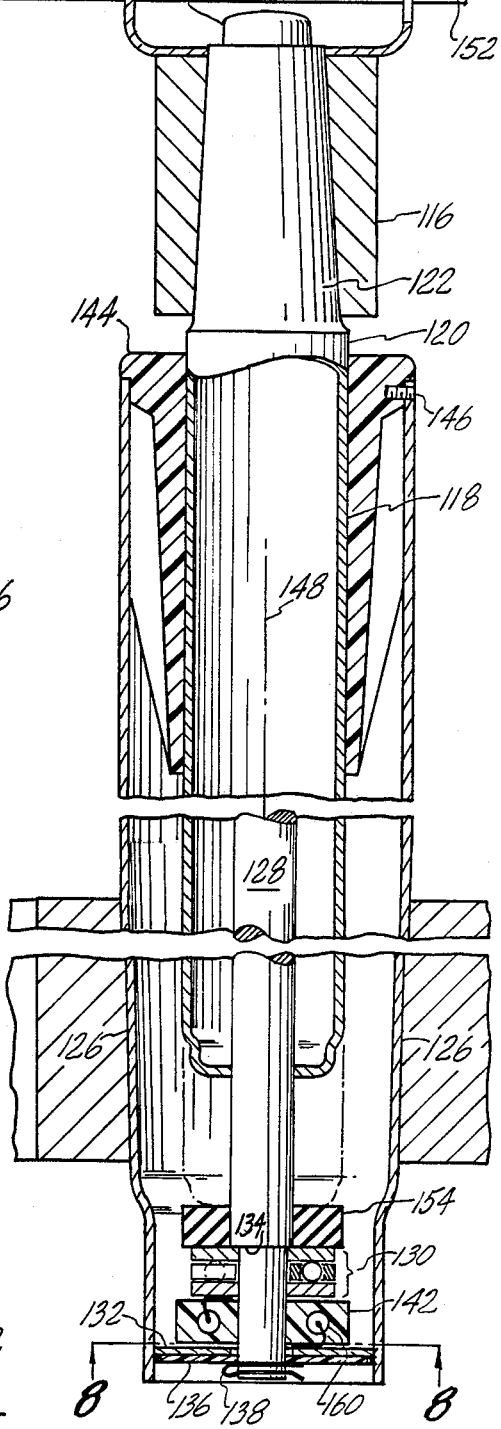

ANTI-STATIC CHAIR

BACKGROUND

This application is a continuation-in-part of copending application Ser. No. 704,162, filed Feb. 22, 1985, now U.S. Pat. No. 4,625,257, which is incorporated herein by this reference and is a continuation-in-part of application Ser. No. 672,617, filed Nov. 19, 1984, now abandoned.

This invention relates to laboratory, production and office work stations such as for assembly, testing and operation of sensitive electronic devices, and more particularly to a chair for safely discharging static electricity.

It is well known that certain electronic devices can easily be damaged by discharges of static electricity. To prevent such damage and to avoid worker discomfort associated therewith, electrically conductive grounded chairs have been used to provide a discharge path for static electricity that does not damage the electronic devices.

A further development of the prior art is the use of electrically conductive cushions or cushion coverings to provide a conductive chair that is comfortable to sit in.

A disadvantage of the electrically conductive chairs of the prior art is that an occupant seated in such a chair can be electrically shocked, and possibly injured by contact with points of relatively low voltage commonly present in the working environment. Where no conductive chair or other path to ground is used, a worker can safely touch conductors having a single elevated potential in excess of 100 volts without shock or injury.

Another disadvantage of chairs having electrically conductive cushions or cushion coverings in the prior art is that many of the electrically conductive materials are expensive to produce.

Accordingly, there is a need for a chair that safely discharges static electricity, without subjecting an occupant to shock if he touches a conductor having moderately elevated potential, and is economical to produce.

SUMMARY

The present invention is directed to an anti-static chair that meets these needs. The chair includes a seat having a conductive element, a grounded member, means for conducting an electrical charge from an occupant of the chair to the grounded member, and means for limiting current levels passing from the occupant to the grounded member for preventing discomfort when discharging high levels of static charge. In one version of the chair, the limiting means includes at least two parallel-connected resistors of approximately equal resistance in series between the conductive element and the grounded member. Thus the present invention provides fail-safe current limiting in that the chair remains operational if an open circuit occurs in one of the resistors, yet the failure is easily detected by measuring the resistance across the parallel combination. The resistors can be a pair of resistors, each having a resistance of approximately one megohm.

The conductive element can be a conductive foam member. Preferably for ease of manufacture, the conductive element is a foam member having a conductive coating extending over a top surface thereof, and continuously on a portion of side and bottom surfaces, the limiting means being connected at the bottom surface. The coating can be a mixture of latex paint and carbon particles.

Preferably the chair includes means for preventing the discharge below a predetermined charge level. The preventing means can be a breakdown device such as a zener diode connected between the conductive element and ground.

In another version of the chair, a supporting member for the occupant has a conductive member proximate the occupant for discharging to ground a static charge on the occupant, and means for preventing the discharge until the charge reaches a predetermined level. The conductive member can be a conductive fabric and the means for preventing can be a Zener diode.

In another version, the chair has a padded support with the conductive element located therein proximate an occupant of the chair. A supporting structure of the chair that permits the seat to be swiveled on a rotational axis has a rotatable electrically conductive frame for the support and an electrically conductive base portion from which the chair can be grounded, an electrically conductive thrust bearing supporting the frame. An important feature of this version is that the limiting means is interposed between the frame and the base, the trust bearing carrying the current. The incorporation of the limiting means between upper and lower portions of the supporting structure protects the occupant from high discharge current levels should there be direct contact between the occupant and the frame, while also continuously maintaining electrical contact between the upper and lower portions during swiveling and adjustment of the chair. The supporting structure can have a hydraulic cylinder unit incorporating the rotational mounting and the thrust bearing, the cylinder providing a convenient vertical adjustment for the chair. The limiting means can include a resistor in series between the frame and the base.

Preferably the chair has an insulating spacer between the thrust bearing and the base, the resistor having its respective leads extending between the spacer and both the thrust bearing and the base. Preferably the spacer is formed for supporting a body portion of the resistor. More preferably, there is a parallel combination of at least two of the resistors on opposite sides of the rotational axis, the leads extending toward the axis form opposite sides in two angularly displaced planes for maintaining alignment of the thrust bearing and continuous electrical contact.

Thus a chair is provided that safely discharges static electricity and is economical to produce, yet does not shock an occupant if he touches a conductor having moderately elevated potential.

DRAWINGS

These and other features, aspects, and advantages of the present invention will become better understood with reference to the following description, appended claims, and accompanying drawings, where:

FIG. 6 is a fragmentary side elevational sectional view of another alternative configuration of the chair of FIG. 1 taken along line 2—2 in FIG. 1;

FIG. 7 is a fragmentary sectional elevational view of the chair of FIG. 6 taken along line 7—7 of FIG. 6; and FIG. 8 is a fragmentary sectional detail view of the chair of FIG. 6 taken along line 8—8 of FIG. 7.

DESCRIPTION

The present invention is directed to a chair capable of discharging a static electrical charge associated with an occupant of the chair without shocking the occupant if he happens to touch a conductive surface connected to a source of moderate electrical potential in the range of 100 to 200 volts.

Mechanical Features

Figure 1:
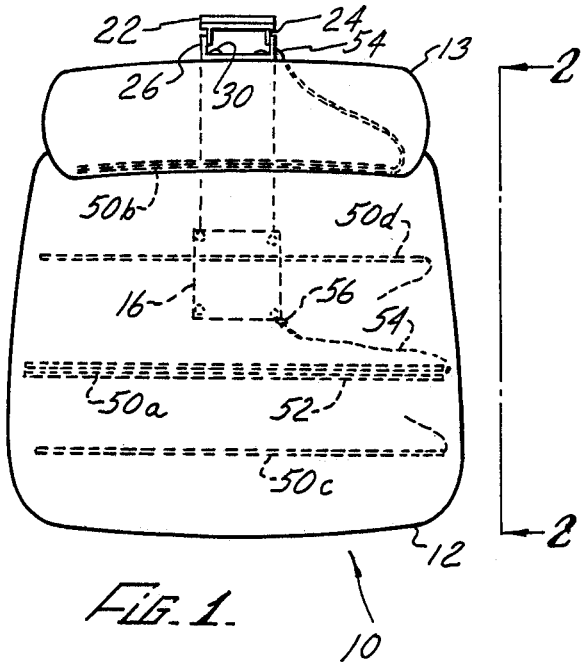
FIG. 1 is a plan view of a chair according to the present invention.
Figure 2:
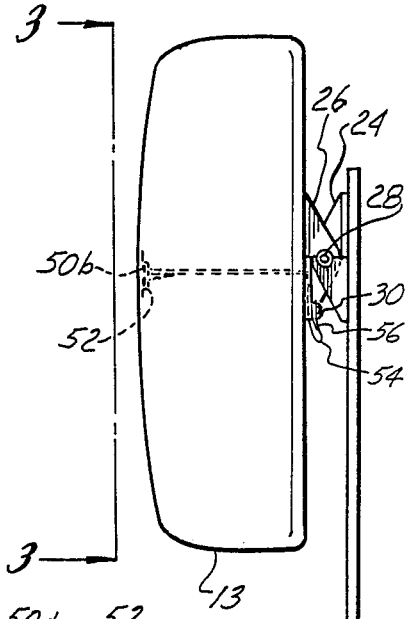
FIG. 2 is a side fragmentary elevational sectional view of the chair of FIG. 1 taken along line 2—2 in FIG. 1.
Figure 2:
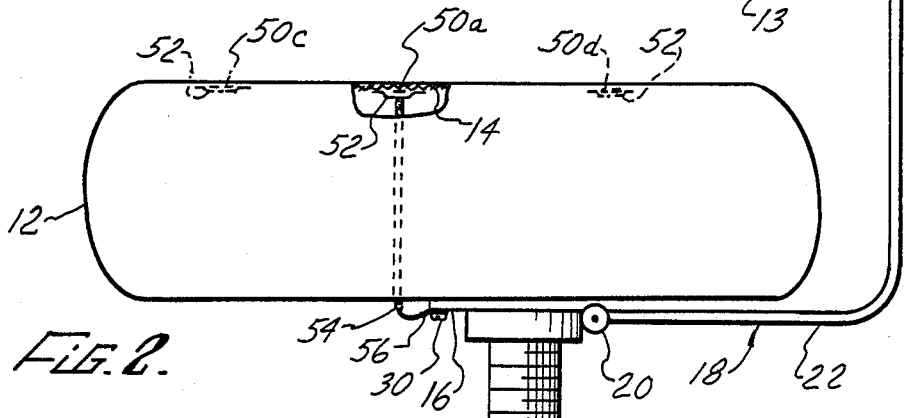
Figure 3:
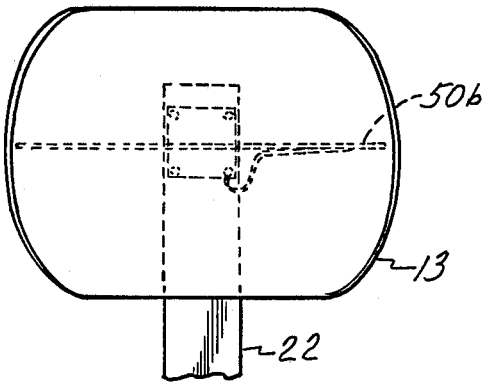
FIG. 3 is a fragmentary front elevational view of the chair of FIG. 1 taken along line 3—3 in FIG. 2.

With reference to FIGS. 1–3, a chair 10, standing on a floor 11, includes a seat 12 and a back 13, the seat 12 and back 13 being covered by a cushion fabric 14. A base assembly 15 provides support for the chair 10 as further described herein.

Preferably the seat 12 and the back 13 are provided with resilient filler materials and/or structure (not shown) for comfortably supporting an occupant of the chair 10.

A seat platform 16, located above the base assembly 15, supports the seat 12 and a back support assembly 18 on the base assembly 15. The back support assembly 18 is fastened to the seat platform 16 by a support attachment 20. The support attachment 20 can incorporate a biasing means (not shown) for resilient mounting of the back support assembly 18 to the seat platform 16. The back support assembly 18 includes a support member 22 extending above the seat 12. A support bracket 24 is fixed to the support member 22 for support of the back 13. A hinge bracket 26, pivotally connected to the support bracket 24 by a hinge pin 28, and is fastened to the back 13 by a plurality of cushion screws 30. A biasing member (not shown) can be connected between the support bracket 24 and the hinge bracket 26 for urging the back 13 into a generally vertical position.

Adjustable Support for the seat platform 16 is provided by a threaded seat post 32 extending downwardly therefrom, the seat post 32 engaging a swivel nut 34 that is supported by the base assembly 15 on a swivel washer 35 that is rotationally locked to the seat post 32 for preventing unwanted movement of the swivel nut 34 thereon. The washer 35 is rotably supported on a flanged swivel bearing 36, the swivel nut 34 prevented from unwanted lifting by a swivel screw 37 that extends inwardly under a portion of the bearing 36. The swivel bearing 36 is supported and located by a column tube 38, the column tube 38 being supported by a plurality of frame members 40 radiating therefrom, each frame member 40 being equipped with a wheel assembly 42 for facilitating movement of the chair 10 on the floor 11. A column sleeve 44 can be provided as a decorative covering for the column tube 38.

As shown in FIGS. 6–8, an alternative configuration of the chair 10 provides a hydraulic cylinder unit 110 for rotatably supporting and vertically adjusting a seat 112, the seat 112 and the back support assembly 18 for the back 13 (not shown) being attached to the cylinder unit 110 by a platform 116. The cylinder unit 110 has a cylinder assembly 118 having a movable pressurized cylinder 120 that is rigidly connected to the platform 116 by frictional engagement with an upper taper portion 122 of the cylinder 120. A stationary outer tube 124 of the cylinder unit 110 is rigidly connected to a frame assembly 140 by frictional engagement with a lower taper portion 126 of the outer tube 124.

A piston rod 128 extends downwardly from the cylinder 120 and is rotatably supported by a ball thrust bearing 130 on a base flange 132 of the outer tube 124, the rod 128 having a shoulder 134 for transmitting an axial load to the thrust bearing 130. The rod 128 protrudes the base flange 132 and a washer 136, a retiner clip 138 preventing separation of the rod 128 from the base flange 132 when the chair 10 is manipulated by lifting of the seat 112. A spacer 142, further described below, is interposed between the thrust bearing 130 and the base flange 132, the rod 128 protruding therethrough. A cylindrical guide bearing 144, attached to the inside of the outer tube 124 and retained by a pin 146, slideably maintains vertical alignment of the cylinder 120 on a rotational axis 148.

A normally closed valve (not shown) within the cylinder 120 has a valve button 150 extending upwardly therefrom for operating the cylinder unit 110. A valve handle 152, pivotably mounted to the platform 116, extends to one side of the seat 112 for convenient operation of the valve button 150 by an occupant of the chair 10. When the valve is opened, the cylinder 120 is permitted to move axially with respect to the rod 128, the seat 112 being biased upwardly by the hydraulic pressure within the cylinder 120. Thus the occupant can vertically adjust the seat 112 while holding the valve open. A resilient bumper 154, resting on the thrust bearing 130, cushions the cylinder 120 at the bottom of its travel.

The cylinder unit 110 can be adapted from a Type 17 or similar pneumatic cylinder that is available from Suspa, M. i., West Germany as described herein. The pneumatic cylinder is modified by the addition of the spacer 142 and the washer 136, the rod 128 being machined to increase the distance from the clip 138 to the shoulder 134 by the aggregate thickness of the spacer 142 and the washer 136.

Electrical Features

In one version of the present invention, the chair 10 is equipped with at least one electrode 50, one such electrode being designated 50a in FIG. 2. Each electrode 50 can be a flexible conductor such as a braided wire. The electrode 50a is located within the seat 12 in contact with the cushion fabric 14 and positioned to be compressed against the cushion fabric 14 when the occupant is in the chair. The electrode 50a can be held in position by an electrode pocket 52, the electrode pocket 52 being sewn to the cushion fabric 14. The electrode 50a, in combination with the cushion fabric 14, forms a breakdown device for preventing electrical shock should the occupant touch a conductor connected to a source of moderate voltage, such as 100–200 volts.

One end of the electrode 50a, extending axially beyond the electrode pocket 52, forms an electrode lead 54, passing through the seat 12 to a point proximate to the seat platform 16. The electrode lead 54 can be terminated by a lead terminal 56 and electrically connected to the seat platform 16 by one of the cushion screws 30.

At least one of the electrodes 50 can be located within the back 13 of the chair 10, such a location being designated 50*b* in FIG. 2. The electrode 50*b* is located within the back 13 against the cushion fabric 14, one end thereof forming an electrode lead 54 extending externally to the back 13 proximately to the hinge bracket 26. The electrode lead 54 is electrically connected to the hinge bracket 26 by a lead terminal 56 and clamped thereto by one of the cushion screws 30. Electrically conductive materials are used in the back support assembly 18 to provide a conductive path from the lead terminal 56, through the support member 22 to the seat platform 16.

As an alternative to the electrode 50*a* in the seat 12, a pair of electrodes 50*c* and 50*d*, each electrically connected to the seat platform 16 as described above, can be longitudinally separated for assuring that at least one of the electrodes 50 will be compressed under the cushion fabric 14 when an occupant is in the chair 10.

The swivel bearing 36 can be made of a non-conductive material such as an acetal resin for electrical isolation of the seat post 32 and the swivel nut 34 from the column tube 38 and the column sleeve 44.

Preferably the chair 12 is provided with means for limiting electrical current levels associated with the discharge of static electricity, so that the discharge is accomplished in a reasonable time and static charge accumulation by the occupant does not damage electronic devices contacted by the occupant, yet not severely shocking an occupant of the chair. A discharge resistor 60 can be connected between the seat post 32 and the base assembly 15 for this purpose. The discharge resistor 60 can have a resistance on the order of one megohm.

The resistance of the discharge resistor 60 can be selected dependent on operating conditions such as the tolerance of the occupant and/or the electronic devices to discharge currents, and the strength and proximity of static charge sources. The selected resistance can range from a nominal value, such as 10 ohms, up to about five megohms.

Preferably the discharge resistor 60 is easily replaceable so that a desired resistance value appropriate for a given operating environment can be conveniently provided. The discharge resistor, enclosed in a non-conductive resistor sleeve 62, can be pressed into a cavity 63 provided in the seat post 32. A first resistor lead 64 can be folded over the resistor sleeve 62 for electrical contact with the seat post 32. A second resistor lead 66, extending below the discharge resistor 60, can be connected by a flexible conductor 68 to the base assembly 15. Thus the resistor 68 is securely mechanically and electrically connected to the seat post 32, yet it can be easily removed and replaced with another having a different resistance. Thus the discharge characteristic of the chair can easily be modified to suit a particular operating environment.

Figures 4A, 5:
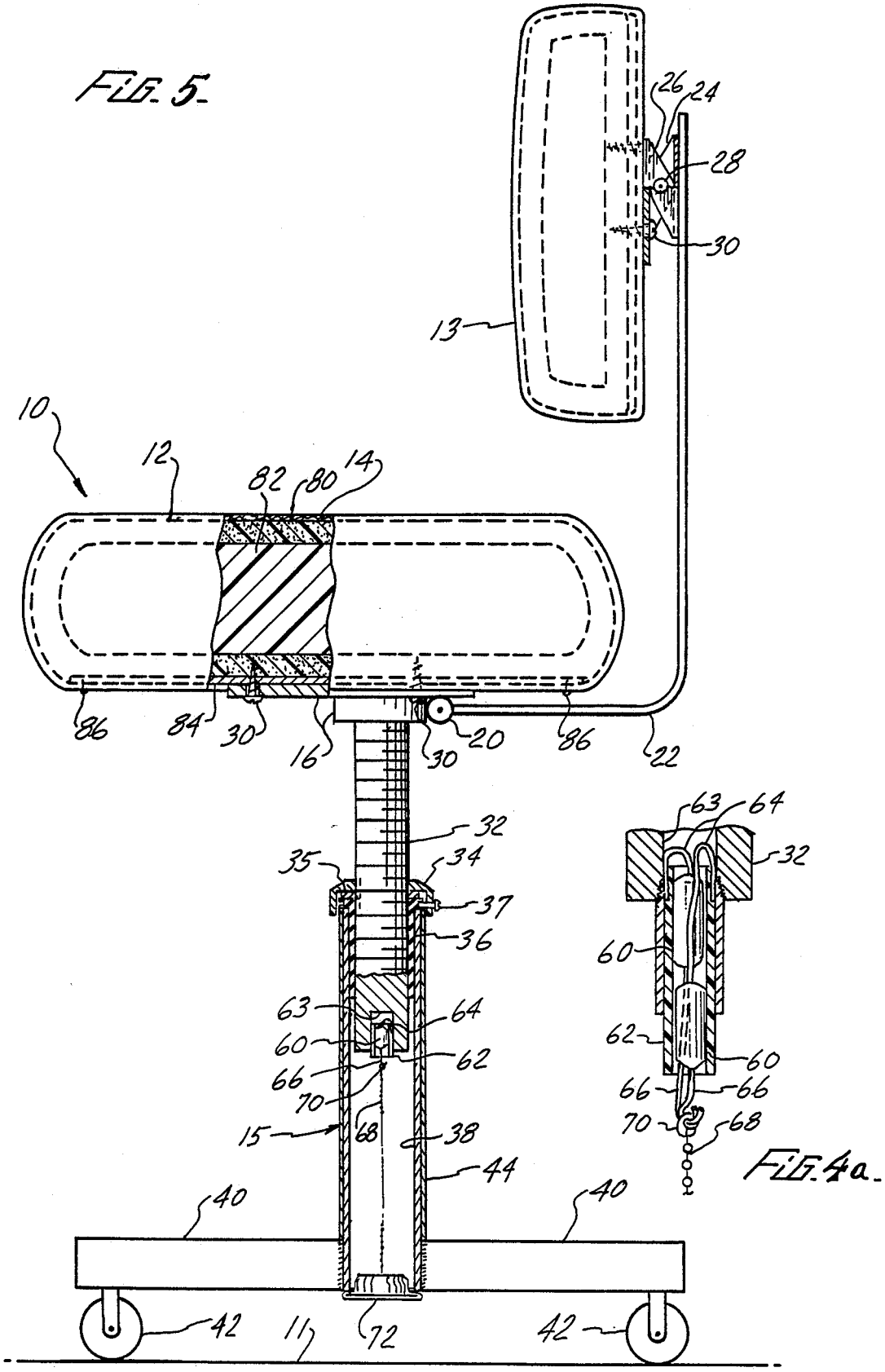
FIG. 4a is a detail of another alternative configuration as in FIG. 4.
FIG. 5 is a fragmentary side elevational sectional view of an alternative configuration of the chair of FIG. 1 taken along line 2—2 in FIG. 1.

As shown in FIG. 4*a*, a preferred configuration of the present invention has at least two of the resistors 60 forming a parallel network between the seat post 32 and the flexible conductor 68.

Also, the resistor sleeve 62 is inserted in a conductive coupling nipple 69 that threadingly engages the seat post 32 for manufacturing convenience. Thus the first resistor lead of each of the resistors is folded over the resistor sleeve 62 for electrical contact with the coupling nipple 69, the inside of the coupling nipple 69 functioning as part of the cavity 63. This configuration is advantageously more reliable than one having a single resistance element. More importantly, the present invention provides fail-safety in that if one of the resistors 60 becomes disconnected or fails in operation, the conductive path from the seat 12 to the base assembly 15 is maintained through a remaining one of the resistors 60. It is further preferred that the resistors 60 have approximately equal resistances for providing a limited change in resistance of the parallel combination before and after an open circuit in any one of the resistors 60. An open circuit condition can easily be detected by measuring with an ohmmeter the resistance between the seat post 32 and the column tube 38, then comparing the measured resistance with a known resistance that is the parallel combination of the resistances of the resistors 60. Thus the present invention remains operational after a failure of one of the resistors 60, yet the failure is easily detectable by routine inspection. For example, in a preferred configuration of the chair 10 in which there are two of the resistors 60, each resistor having a resistance of about one megohm, the measured resistance is normally about 500 k ohms. If the measured resistance, which can be determined periodically for preventative maintenance, is about one megohm, an open circuit is indicated in one of the resistors 60, yet no damage to the sensitive devices will have occurred because the one megohm resistance is effective for discharging the static charges. Accordingly, the present invention provides enhanced reliability by preventing expansive damage to sensitive electronic devices even in the unlikely occurrance of an open circuit in one of the resistors 60.

The flexible conductor 68 can be a beaded metallic chain for conveniently providing continuous electrical contact between the discharge resistor 60 and the base assembly 15 regardless of the position and orientation of the seat post 32 with respect to base assembly 15. The beaded metallic chain provides a further advantage in that endless swivelling of the chair does not interrupt the electrical contact.

In order to insure the continuous electrical contact of the beaded chain of the flexible conductor 68, the chain can be treated to remove non-conducting matter from the beads and links thereof. The chain can be further treated with a deposit of conducting material such as powdered graphite. The powdered graphite can be suspended in a volatile solvent in which the chain is washed, then deposited on the chain as the solvent evaporates. Thus the removal of non-conducting matter and the deposit of conducting material is easily accomplished in a single operation.

The second resistor lead 66 of each resistor 60 can be conveniently looped through a conventionall coupling link 70 such as is commonly supplied with beaded chain. A plug cap 72 can be pressed into the column tube 38 for providing a conductive support for the flexible conductor 68. Preferably the wheel assemblies 42 are made using electrically conductive materials for completing an electrical connection from the plug cap 72, through the column tube 38 and the frame members 40 to the floor 11. It is understood that the floor 11 is electrically conductive in a typical environment for the chair 10. Alternatively, the base assembly 15 can be electrically connected to ground by a suitable ground lead (not shown).

Figure 4:
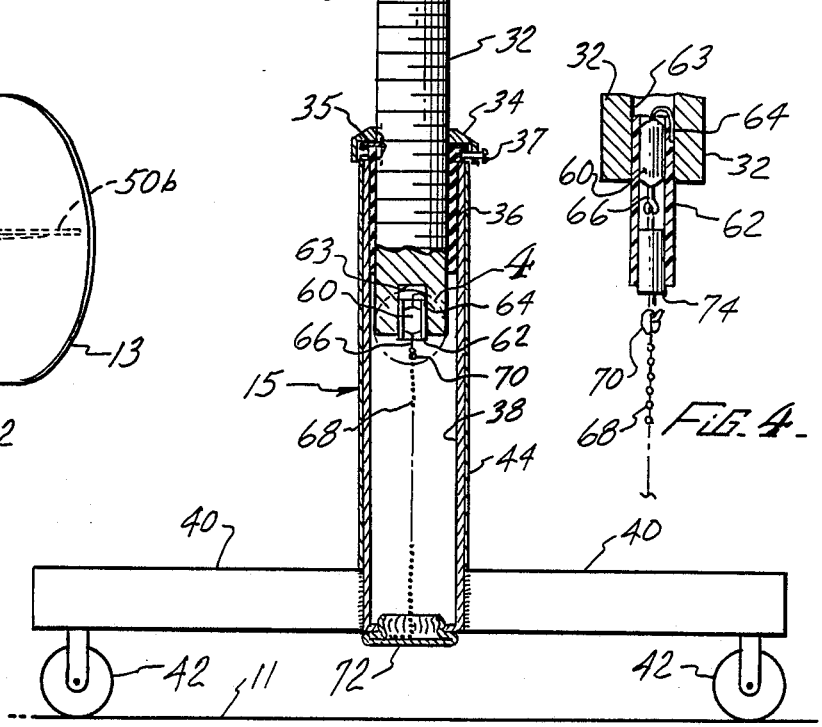
FIG. 4 is a detail of an alternative configuration of the chair of FIG. 1 within region 4 in Fig. 3.

In another version of the chair of the present invention, the cushion fabric 14 can be made electrically conductive, the electrode 50 and the electrode pocket 52 no longer being required. With reference to FIG. 4, a discrete breakdown device 74, such as a zener diode, can be electrically connected in series between the seat post 32 and the base assembly 15. The breakdown device 74 can be a bipolar semiconductor device comprising a pair of zener elements connected back-to-back for symmetrical positive and negative discharge characteristics. The resistor sleeve 62 can be elongated below the discharge resistor 60 for providing lateral support for the breakdown device 74, the breakdown device 74 being electrically and mechanically connected between the discharge resistor 60 and the coupling link 70. The breakdown characteristics of the breakdown device 74 can be selected to set a predetermined static discharge threshold. For example, a zener diode having a voltage raging of 200 volts would protect an occupant of the chair from being shocked should he touch a source of less than 200 volts.

With reference to FIG. 5, a further version of the chair of the present invention includes conductive padding in the seat 12 and/or the back 13. For example, the conductive padding can be a flexible or resilient conductive foam member 80, located within the seat 12 in contact with the cushion fabric 14. The conductive foam member 80 can facilitate construction of the chair 10 by functioning as an electrode in place of the electrode 50, the electrode pocket 52, electrode lead 54, and lead terminal 56.

The conductive foam member 80 can comprise a conductive material such as carbon and a generally non-conducting foam material such as polypropylene, polyethelyne, or polyurethane. The conductive material can be dispersed in the foam material or deposited thereon in a polymeric coating. The conductive material is normally dispersed in closed-cell foams such as polypropylene and polyethelyne, but deposited onto open-celled polyurethane, because polyurethane is subject to non-uniform curing when mixed with carbon.

Commercially manufactured poyurethane foam having desirable mechanical and electrical properties is known as "low density conductive foam," and has a density of from about one to three pounds per cubic foot. One formulation, having a surface resistivity of $10^4$ ohms/square and a volume resistivity of $10^5$ ohms/cm, sold under the trademark Condulon, is available from Bemis Company, Minneapolis, Minn. Another formulation, having a surface resistivity of $3\times10^4$ ohms/square and a volume resistivity of $3\times10^3$ ohms/cm, is available from Charles Water Products, Inc., West Newton, Mass. A further formulation, available from Great Western Foam Co., Los Angeles, Calif., has a surface resistivity of $10^3$ ohms/square and a volume resistivity of $10^4$ ohms/cm.

Flexible conductive foam material is readily available in thicknesses of from about ⅛ inch to about one inch. Consequently, the conductive foam member 80 can be configured to surround a nonconducting conventional foam member 82, inexpensively providing sufficient foam for the seat 12. It has been found that the best combination of mechanical and electrical properties results when the conductive foam member 80 has a thickness of from one-quarter to one-half inch.

The conductive foam member 80 (and the conventional foam member 82) can be supported by the seat platform 16 on a cushion panel 84. Electrical contact between the seat platform 16 and the conductive foam member 80 can be provided by selecting the cushion screws 30 of sufficient length to protrude into the conductive foam through the cushion panel 84.

The cushion fabric 14 can extend under the cushion panel 84, fastened thereto by a plurality of staples 86 for confining the conductive foam member 80 within the seat 12 (and the back 13).

The chair 10, having a conductive foam member 80 one-quarter inch thick made from the Great Western foam, has a conductive path measuring from approximately 500 k ohms to approximately 1 megohm between the top of the seat (under the cushion fabric 14) and the seat platform 16. When the Charles Water Products' foam is substituted, the measured resistance decreases to from approximately 40 k ohms to approximately 90 k ohms. This resistance can be conveniently measured while piercing with a suitable probe the conductive foam member 80, proximate to the center of the seat 12.

In most applications, a current limiting resistance of about 1 megohm is desired between the seat and ground potential, as described above. Thus, when using low resistivity foam such as the Charles Water Products' foam, the function of the discharge resistor 60 is relatively unchanged by substitution of the conductive foam member 80 for the electrode 50.

Alternatively, sufficient electrical resistance can be provided in the conductive foam member 80, using the Great Western foam, for example, to produce a desired degree of current limiting, thus avoiding the need for the discharge resistor 60. The resistance can be increased by using foam of lower conductivity and/or decreased thickness. Moreover, a labyrinth pattern can be incorproated into the conductive foam member 80 between the cushion screws 30 and the sides of the seat 12 for increased electrical resistance.

In the configuration shown in FIGS. 6–8, the seat 112 has a foam cushion 182 on the cushion panel 184, the cushion 182 being covered by the cushion fabric 14, the fabric 14 being fastened under the panel 184 by the staples 86 as described above. The cushion panel 184 is fastened to the platform 116 by a plurality of screws 186 that extend through the platform 116 into engagement with corresponding threaded inserts 188 that are anchored to the top of the cushion panel 184. The foam cushion 182 has a conductive coating 180 extending substantially over a top surface 190 thereof. The conductive coating 180 also extends continuously from the top surface 190, down at least a portion of a side surface 192, to at least a portion of a bottom surface 194 of the foam cushion 182. An aluminum adhesive strip 196 is attached to the top of the cushion panel 184, extending from under a portion of the conductive coating 180 proximate the side surface 192 and being pierced by a pair of the threaded inserts for electrically connecting the conductive coating 180 to the threaded inserts 188.

A continuous electrical path of low resistance exists between the cylinder 120 and the rod 128 of the above-described cylinder unit 110. Thus a low-resistance discharge path exists from the conductive coating 180 on the top surface 190, down the side surface 192 and the bottom surface 194, across the adhesive strip 196, and down through the threaded inserts 188, the screws 186, the platform 116 and the cylinder 120, to the rod 128. Also, there is a low-resistance path from the outer tube 124 into the frame assembly 140, then through the wheel assemblies 42 to the floor 11 as described above.

For limiting the electrical current levels associated with the discharge of static electricity, the guide bearing 144 of the cylinder unit 110 comprises a non-conductive material such as an acetal resin. Also, the spacer 142 and the washer 136 comprise a non-conductive material such as nylon for electrically isolating the rod 128 from the base flange 132 of the outer tube 124, the rod 128 being prevented from contacting the base flange 132 by the guide bearing 144 that locates the cylinder 120 on the rotational axis 148. With particular reference to FIGS. 7 and 8, one, or preferably at least two resistors 160 are connected between the thrust bearing 130 and the base flange 132 for permitting limited current flow from the platform 116 through the cylinder 120 into the base flange of the outer tube 124.

Each of the resistors 160 has a body 162, and first and second conductive leads 164 and 166 extending therefrom, the first lead 164 extending between the spacer 142 and the thrust bearing 130, the second lead 166 extending between the spacer 142 and the base flange 132. A cylindrical cavity 168 is formed in the spacer 142 for supporting the body 162 of each of the resistors 160. As shown in FIG. 8, there are two of the resistors 160, each being supported in a corresponding cavity 168. The cavities 168 are cylindrical, extending in parallel relation on opposite sides of the rod 128.

For preserving alignment of the thrust bearing 130, and maintaining a parallel electrical path in the resistors 160 between the thrust bearing and the base flange 132, the first leads 164 extend between the spacer 142 and the thrust bearing 130 from opposite sides toward the rod 128, and the second leads 166 extend between the spacer 142 and the base flange 132 from opposite sides toward the rod 128, the second leads 166 being displaced angularly about the rotational axis 148 with respect to the first leads 174. As shown in FIG. 8, the angular displacement D of the first leads 164 from the second leads 166 is about 90°.

Thus the present invention provides a modification of a conventional pneumatic cylinder unit for limiting electrical current therethrough, including the steps of removing the clip 138, separating the cylinder assembly 118 from the thrust bearing 130 and the outer tube 124, machining the rod 128 for displacing the shoulder 134 away form the clip 138, assembling the thrust bearing 130 and the spacer 142 together with the resistors 160 onto the rod 128, then replacing the cylinder assembly 118 into the outer tube 124 and installing the washer 136 and the clip 138.

Operation

In operation, the base assembly 15 is maintained at ground potential by contact of the wheel assemblies 42 with a conductive surface of the floor 11. Alternatively, the base assembly 15 is connected by a suitable wire to a source of ground potential.

When no current is flowing through any of the electrodes 50, the electrodes 50 are held at ground potential by use of a conductive path through the discharge resistor 60. When a person carrying a high voltage static charge sits in the chair 10, the cushion fabric 14 is pressed tightly between the occupant and at least one electrode 50, producing a narrow gap between the body of the person and the electrode 50. A voltage potential gradient sufficient to permit current flow is created within the gap. The current, limited by the discharge resistor 60, continues to flow until the static charge has been reduced to a level below which current ceases to flow.

When an occupant of the chair 10 touches a conductor at a moderate potential (up to about 200 volts, depending on properties of the cushion fabric 14) the potential gradient in the gap is lower than that required for meaningful current flow. Thus the electrode 50, in combination with the cushion fabric 14, functions as a breakdown device so that the occupant is not shocked when he touches the conducting surface.

It should be understood that the construction and electrical properties of the seat 12 and the back 13 may be made similar to intentionally divergent within the scope of the present invention.

The chair of the present invention provides protection for sensitive electronic devices from damaging static electric discharge by draining static charges from an occupant. However, the occupant can touch sources of current at moderate voltages without fear of being shocked.

Although the present invention has been described in considerable detail with reference to certain preferred versions thereof, other versions are possible. For example, the base assembly 15 can be integrated with structure for a work bench, with or without the wheel assemblies 42. Also, a parallel combination of the breakdown device 74 and the discharge resistor 60 with another resister can be used to alter the discharge characteristics of the chair. Therefore, the spirit and scope of the appended claims should not necessarily be limited to the description of the preferred versions thereof.

What is claimed is:

1. A chair for discharging a static electrical charge carried by an occupant of the chair, the chair comprising:

(a) a seat comprising an electrode for discharging a static electrical charge carried by the occupant;

(b) means for connecting the electrode to a source of ground potential; and (c) means for limiting electrical current flow between the electrode and the means for grounding, the limiting means comprising a first resistor connected in series between the electrode and the source of ground potential, and a second resistor connected in parallel with the first resistor, the first and second resistors having approximately equal resistance.

2. The chair of claim 1 wherein the resistors each have a resistance of about 500 k ohms.

3. The chair of claim 1 wherein the electrode comprises a conductive foam member.

4. The chair of claim 3 wherein the conductive foam member comprises:

(a) a foam member having top, bottom, and side surfaces; and

5. The chair of claim 4 wherein the coating comprises a mixture of latex paint and carbon particles.

6. The chair of claim 1 further comprising means for preventing the discharge until the charge exceeds a predetermined level.

7. The chair of claim 6 wherein the means for preventing comprises a breakdown device connected between the electrode and the means for grounding.

8. A chair for discharging a static electrical charge carried by an occupant of the chair, the chair comprising:

(a) a padded supporting member for the occupant, the supporting member having a conductive element located proximate the occupant;

(b) an electrically conductive structural member supporting the supporting member, the structural member being electrically connected to the conductive element;

(c) an electrically conductive base for grounding the chair, the structural member being rotatably mounted to the base on a rotational axis, an electrically conductive thrust bearing being interposed between the structural member and the base for rotatably transmitting a load reaction force from the structural member to the base; and (d) means for limiting electrical current between structural member and the base, the thrust bearing carrying the current, the limiting means comprising a first resistor connected in series between the structural member and the base, and a second resistor connected in paralle with the first resistor, the first and second resistors having approximately equal resistance.

9. The chair of claim 8 further comprising a hydraulic cylinder unit for vertically adjusting the supporting member, the hydraulic cylinder unit incorporating the rotatable mounting of the frame member and the thrust bearing.

10. The chair of claim 8 further comprising means for preventing the discharge until the charge reaches a predetermined level.

11. The chair of claim 10 wherein the means for preventing the grounding comprises a layer of material having low electrical conductivity located between the conductive element and the occupant.

12. The chair of claim 10 in which the conductive element comprises a conductive foam member.

13. The chair of claim 8 further comprising an insulating spacer between the thrust bearing and the base for electrically isolating the structural member from the base, each resistor having first and second wire leads for electrical connections thereto, the first lead extending between the spacer and the thrust bearing and the second lead extending between the spacer and the base for connecting the resistor in series between the thrust bearing and the base.

14. The chair of claim 13 wherein the resistor has a body portion between the first and second leads and the spacer is formed for supporting the body portion of the resistor between the thrust bearing and the base.

15. The chair of claim 14 wherein the resistors are on opposite sides of the rotational axis, the first leads of the resistors extending between the spacer and the thrust bearing from opposite sides of the rotational axis, the second leads of the resistors extending between the spacer and the base from opposite sides of the rotational axis in a direction angularly displaced about the axis from the first leads for maintaining axial alignment of the thrust bearing and electrical connection of the resistors in parallel between the thrust bearing and the base.

16. A chair for discharging a static electrical charge carried by an occupant of the chair, the chair comprising:

(a) a seat comprising at least one resilient conductive member, the resilient conductive member being capable of discharging a static electrical charge carried by the occupant;

(b) an electrically conductive structural member supporting the seat, the structural member being electrically connected to the resilient conductive member;

(c) an electrically conductive base, the structural member being rotatably mounted to the base on a rotatioal axis;

(d) an electrically conductive thrust bearing mounted between the structural member and the base for rotatably transmitting a load reaction force from the structural member to the base; and (e) means for limiting electrical current between the structural member and the base comprising:

(i) means for electrically insolating the structural member from the base, including an insulating spacer between the thrust bearing and the base, the insulating spacer transmitting the reaction force; and (ii) at least two resistors connected between the thrust bearing and the base, each resistor having first and second conductive leads, the first lead extending between the spacer and the thrust bearing, the second lead extending between the spacer and the base, the leads being clamped therebetween by the reaction force for maintaining electrical continuity between the supporting member and the base during rotation of the structural member, at least a portion of the electrical current being conducted through the thrust bearing.

17. A chair for discharging a static electrical charge carried by an occupant of the chair, the chair comprising:

(a) a padded supporting member for the occupant, the supporting member comprising:

(i) a conductive element comprising a conductive member located proximate the occupant; and (ii) a layer of material having low electrical conductivity covering the conductive element for preventing the discharge until the charge reaches a predetermined level;

(b) an electrically conductive structural member supporting the supporting member, the structural member being electrically connected to the conductive element;

(c) an electrically conductive base, the structural member being rotatably mounted to the base on a rotational axis;

(d) an electrically conductive thrust bearing mounted between the structural member and the base for rotatably transmitting a load reaction force from the structural member to the base; and (e) means for limiting electrical current between the structural member and the base comprising:

(i) means for electrically isolating the structural member from the base, including an insulating spacer between the thrust bearing and the base, the insulating spacer transmitting the reaction force; and (ii) a resistor connected between the thrust bearing and the base, the resistor having first and second conductive leads, the first lead extending between the spacer and the thrust bearing, the second lead extending between the spacer and the base, the leads being clamped therebetween by the reaction force for maintaining electrical continuity between the supporting member and the base during rotation of the structural member, at least a portion of the electrical current being conducted through the thrust bearing.

* * * * *